US008360804B1

(12) United States Patent
Meister

(10) Patent No.: US 8,360,804 B1
(45) Date of Patent: Jan. 29, 2013

(54) RETAINING MECHANISMS FOR HIGH DEFINITION MULTIMEDIA INTERFACE

(75) Inventor: Douglas L Meister, Loganville, GA (US)

(73) Assignee: Cisco Technology, Inc., San Jose, CA (US)

( * ) Notice: Subject to any disclaimer, the term of this patent is extended or adjusted under 35 U.S.C. 154(b) by 535 days.

(21) Appl. No.: 12/561,494

(22) Filed: Sep. 17, 2009

Related U.S. Application Data

(60) Provisional application No. 61/112,181, filed on Nov. 6, 2008.

(51) Int. Cl.
*H01R 13/627* (2006.01)

(52) U.S. Cl. ..... 439/564; 439/350

(58) Field of Classification Search ..... 439/350, 439/373, 564, 573
See application file for complete search history.

(56) References Cited

U.S. PATENT DOCUMENTS

| | | | | |
|---|---|---|---|---|
| 5,928,023 | A * | 7/1999 | Buckner et al. | 439/373 |
| 6,422,892 | B1 * | 7/2002 | Chen et al. | 439/378 |
| 6,520,792 | B2 * | 2/2003 | Chen-Chiang et al. | 439/373 |
| 6,811,415 | B2 * | 11/2004 | Chen | 439/133 |
| 7,214,087 | B2 * | 5/2007 | Kuo | 439/364 |
| 7,374,454 | B1 * | 5/2008 | Wang | 439/536 |
| 2009/0011624 | A1 * | 1/2009 | Yamazaki | 439/99 |

FOREIGN PATENT DOCUMENTS

WO WO 2006098312 A1 * 9/2006

* cited by examiner

*Primary Examiner* — Tulsidas C Patel
*Assistant Examiner* — Travis Chambers
(74) *Attorney, Agent, or Firm* — Meunier Carlin & Curtman, LLC

(57) ABSTRACT

In one embodiment, a retaining mechanism for a high definition multimedia interface connection that can aid in preventing inadvertent separation of a high definition multimedia interface cable with a device to which it is connected.

14 Claims, 11 Drawing Sheets

RETAINING MECHANISMS FOR HIGH DEFINITION MULTIMEDIA INTERFACE

RELATED APPLICATION

This application claims the benefit under 35 U.S.C. §119 (e) of U.S. Patent Application No. 61/112,181 filed on Nov. 6, 2008, which is incorporated by reference in this application in its entirety.

TECHNICAL FIELD

The present disclosure relates generally to high definition multimedia interface (HDMI) cables and connectors.

BACKGROUND

HDMI cables carry uncompressed digital audio and video over a single cable providing a simple and convenient way for consumers to connect devices such as a cable box or video game system to digital televisions and other devices. Connecting an HDMI cable to a device merely requires that an HDMI connector on the end of a cable be inserted into a HDMI connector/port on the device. Generally the insertion force required to do so is relatively low as is the extraction force required to remove a cable from a device. Unfortunately this low extraction force can cause problems in some instances. For example, a cable that is inadvertently pulled can become completely or partially dislodged from the device causing, for example, weak, intermittent, or nonexistent electrical connections at the connection, signal interruption and/or connector damage. This can be particularly troublesome in equipment installations where devices and/or their connections cannot be easily accessed.

OVERVIEW

In general, one aspect of the subject matter described in this specification can be embodied in an apparatus including a male high definition multimedia interface (HDMI) connector, a retaining tab comprising a vertical plate having a retaining hole, and a horizontal plate connected to the vertical plate, the retaining tab being configured to receive a fastener for maintaining the male HDMI connector in a position in which the male HDMI connector is mated to a female HDMI connector of a device.

One aspect of the subject matter described in this specification can be embodied in an apparatus including a male high definition multimedia interface (HDMI) connector and means for retaining the male HDMI connector to a device having a female (HDMI) connector.

One aspect of the subject matter described in this specification can be embodied in an apparatus including a high definition multimedia interface (HDMI) connector retaining tab comprising a vertical plate, a horizontal plate connected to the vertical plate, and first and second retaining prongs being spaced apart so as to lie on respective sides of an HDMI cable to which the HDMI connector retaining tab is proximate and configured to press against a sheath of the HDMI cable to hold a male HDMI connector of the cable in a position in which the male HDMI connector is mated to a female HDMI connector of a device.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DESCRIPTION OF EXAMPLE EMBODIMENTS

Figure 1:
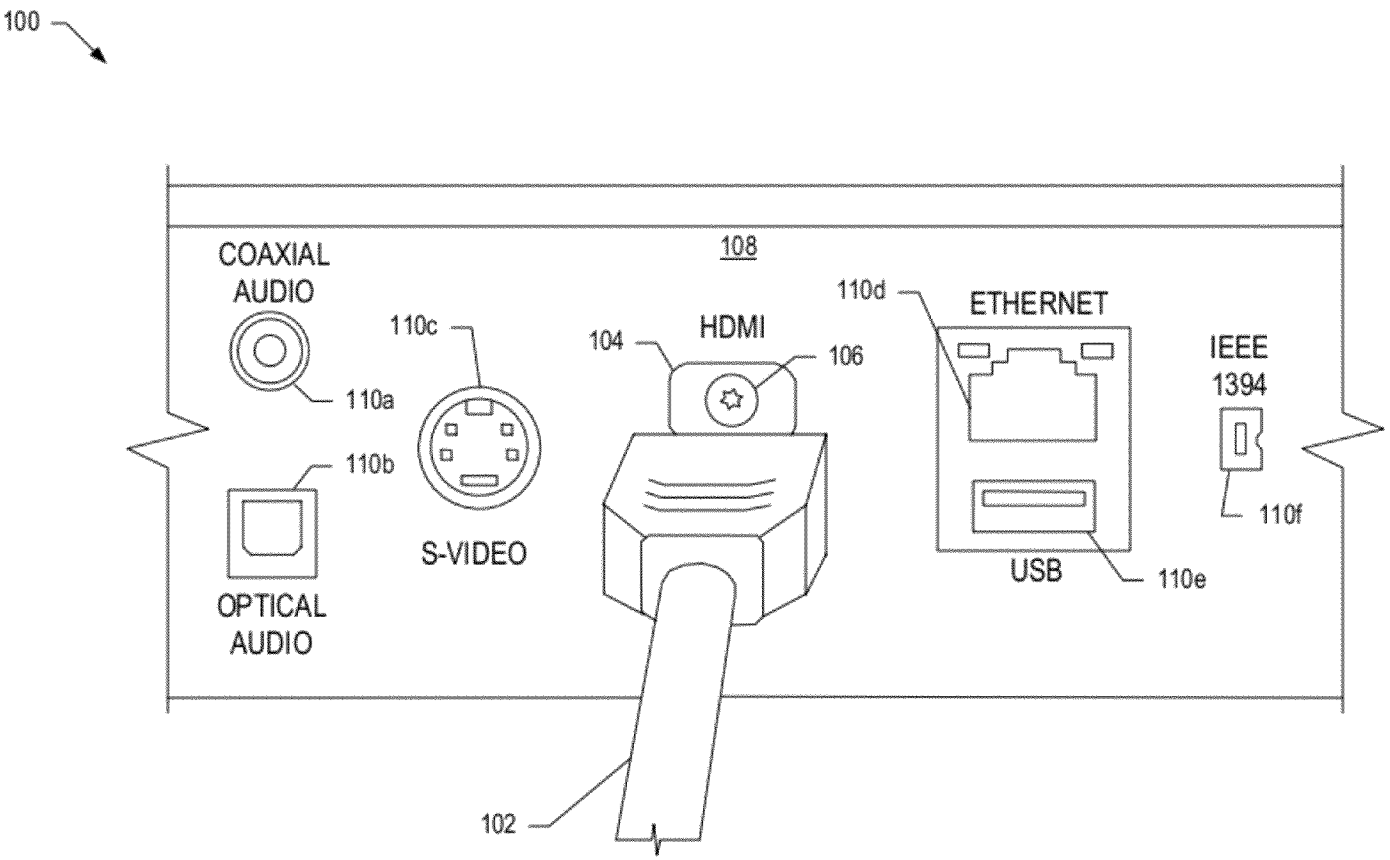
FIG. 1 illustrates an example environment of an HDMI cable with an example retaining mechanism.

FIG. 1 illustrates an example environment 100 of an HDMI cable 102 with an example retaining mechanism. The HDMI cable 102 is connected to an example device 108 that includes an HDMI port as well as additional connections 110*a*-110*f*. The device 108 can be, for example, a set top box, television, monitor, gaming system, audio/video receiver, optical disc player, video recorder, video player, or an HDMI switch.

The example retaining mechanism depicted in FIG. 1 includes a retaining tab 104. The tab 104 includes a hole through which a screw 106 can, for example, pass through and be threaded into a corresponding hole on the device 108.

Figure 2A:
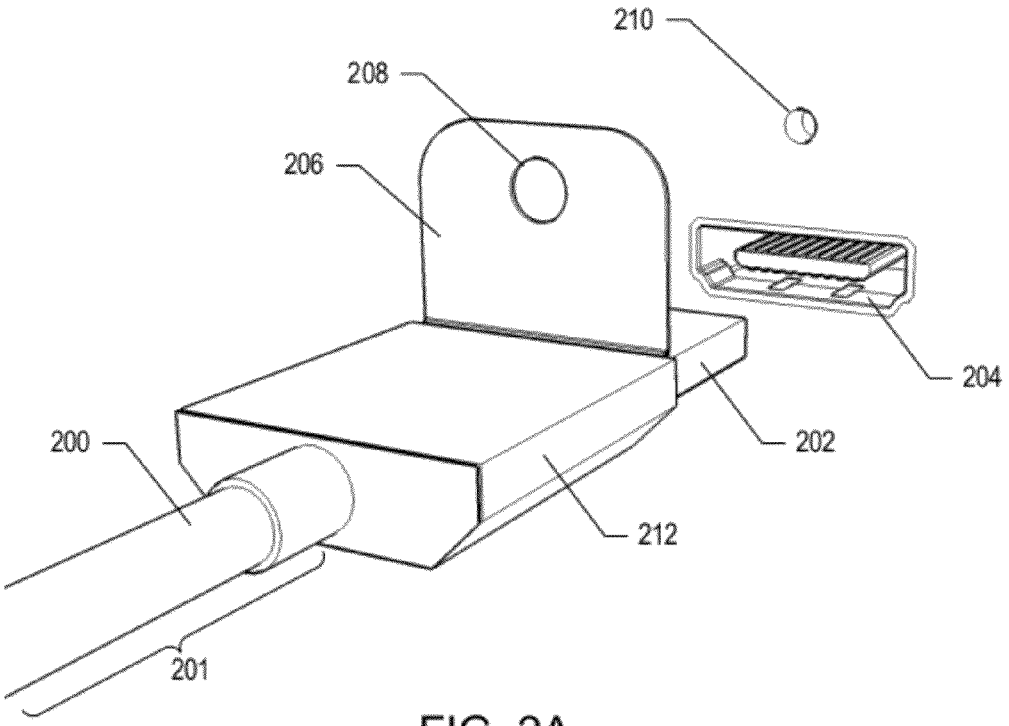
FIGS. 2A-2D illustrate an example HDMI cable with a retaining mechanism.

FIGS. 2A-2D illustrate an example HDMI cable 200 with a retaining mechanism. FIG. 2A illustrates an example HDMI cable 200 having a male HDMI connector 202 prior to insertion into a female HDMI connector 204. The HDMI cable 200 includes a retaining tab 206 with retaining hole 208. A receiving hole 210 is located above the female HDMI connector 210. The HDMI cable 200 can also include a connector sheath 212 (made of molded plastic, for example) between the male HDMI connector 202 and the insulated wire section 201 of the cable 200 for strain relief and protection of individual wire to pin connections at the male connector 202. The sheath 212 can also provide a gripping area to permit a human hand to grip the cable connector for inserting and removing the HDMI cable 200 from HDMI enabled devices.

Figure 2B:
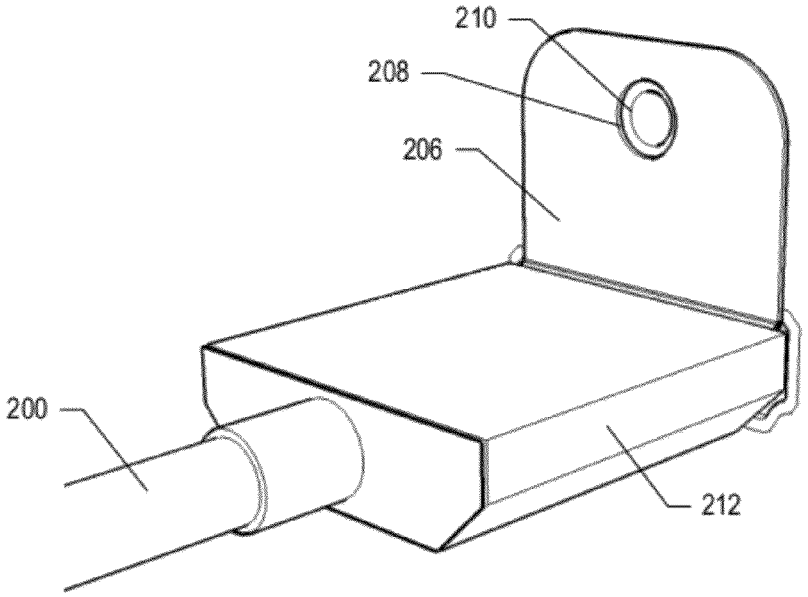

FIG. 2B illustrates the example HDMI cable 200 following its insertion into the female HDMI connector 204. The retaining hole 208 is substantially aligned with the receiving hole 210.

Figure 2C:
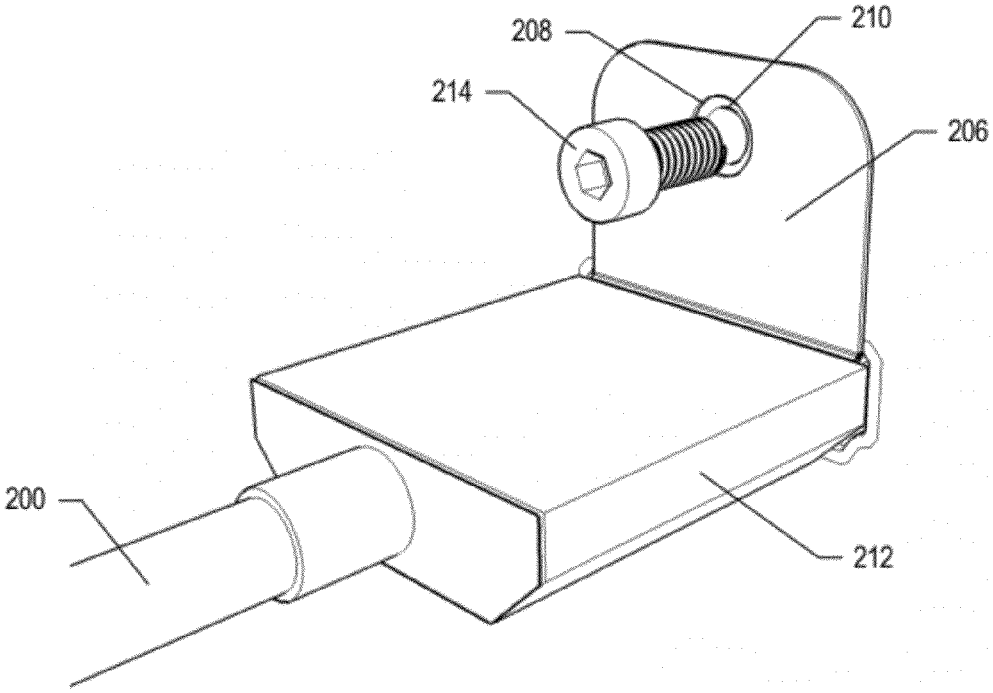
Figure 2D:
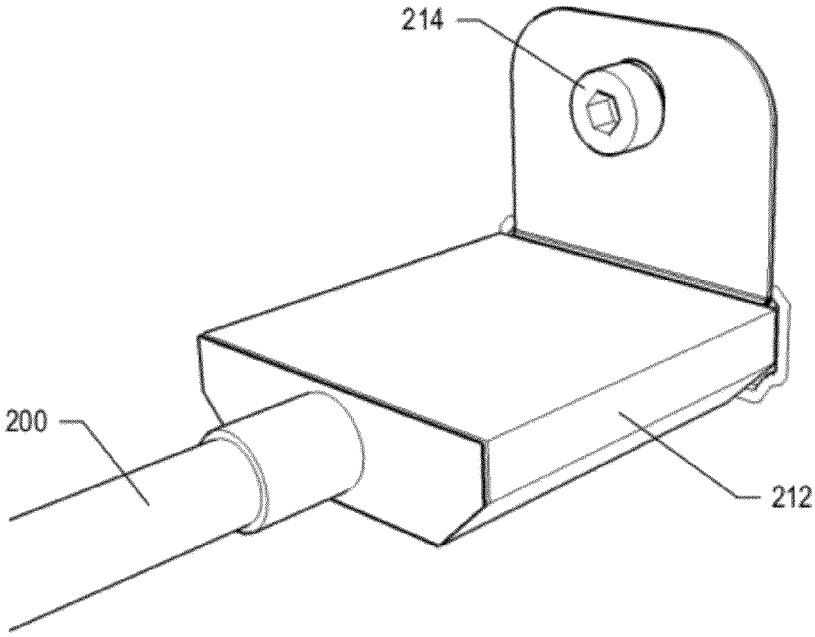

FIG. 2C illustrates the example HDMI cable 200 prior to insertion of a retaining screw 214, and FIG. 2D illustrates the example HDMI cable 200 following insertion of the retaining screw 214. The possibility of inadvertent complete or partial removal of the male HDMI connector 202 from the female HDMI connector 204 is substantially reduced or eliminated with the retaining screw 214 in place.

In some implementations, the retaining tab 206 is made of metal and is electrically connected to a ground wire and/or shielding wire of the HDMI cable 200. In these implementations an improved grounding condition between two devices connected by the HDMI cable 200 can be maintained with the retaining screw 214 in place. The retaining screw 214 can provide an electrical connection between the retaining tab 206 and a chassis of a device to which the HDMI cable 200 is connected.

Figure 2E:
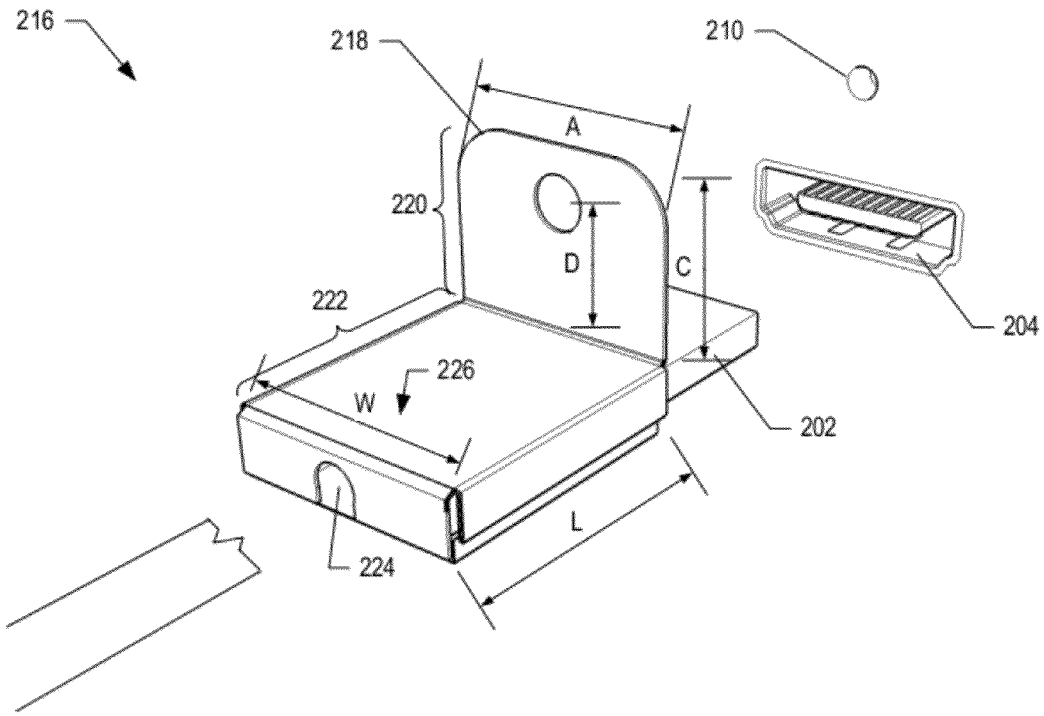
FIG. 2E illustrates an example HDMI cable having an integrated retaining tab and shielding case.

FIG. 2E illustrates an example HDMI cable 216 having an integrated retaining tab and shielding case 218. For purposes of illustrating details of the HDMI cable 216, the sheath (molded plastic, for example) and a portion of the insulated cable are not shown in FIG. 2E. The integrated retaining tab and shielding case 218 includes a retaining tab portion 220 and a shielding case portion 222. In some implementations, the retaining tab portion 220 and the shielding case portion 222 can be made of a single piece of metal. The shielding case portion 222 can cover a portion of the male HDMI connector 202 and/or an interface area between the male HDMI connector and individual conductors of the cable 216 to, for example, reduce radio frequency (RF) interference with signals carried by the cable 216. The integrated retaining tab and shielding case 218 includes a conductor passage 224 to permit conductors in the cable to pass through to the interior of the shielding case. In some implementations, a complete shielding case is formed by the shielding case portion 222 and a shielding case bottom that can, for example, snap together with the shielding case portion 222. In some implementations, a shielding wire of the cable 216 can be electrically connected to the integrated retaining tab and shielding case 218. For example, the shielding of the cable 216 can be soldered or otherwise held to the surface 226 of the shielding case portion 222 and/or other surfaces of the shielding case portion 222.

The retaining tab portion 220 can have a width dimension 'A', a height dimension 'C', and a height to center of the retaining hole dimension 'D'. In some implementations, 'A' can be approximately 13 millimeters. In some implementations, 'A' is equal to or less than the width of a male HDMI connector (approximately 14 millimeters) but greater than the diameter of the retaining hole 208 (e.g., 3 millimeters). In some implementations, 'C' can be approximately 9 millimeters. In some implementations, 'D' can be approximately 6 millimeters. The shielding case portion 222 can have a width dimension 'W', a length dimension 'L' and a height dimension 'H'. In some implementations, 'W' can be approximately 16 millimeters. In some implementations, 'L' can be approximately 25 millimeters. In some implementations, 'H' can be approximately 6 millimeters.

Figure 3A:
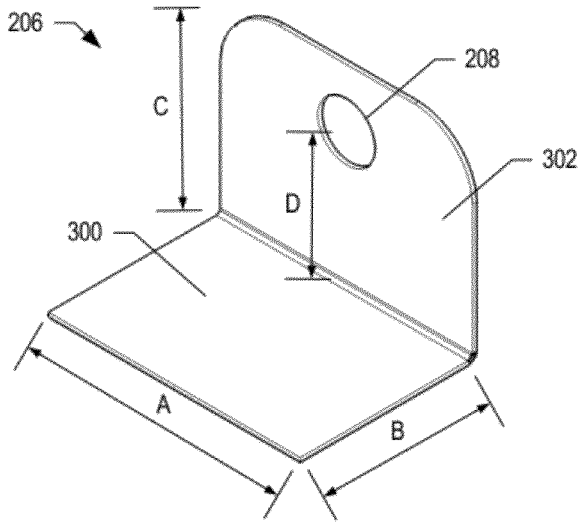
FIGS. 3A-3C illustrate an example retaining tab.
Figure 3B:
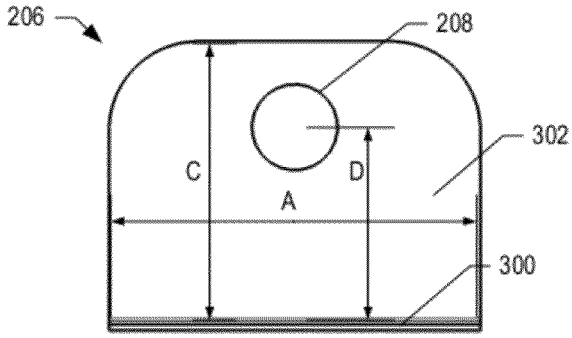
Figure 3C:
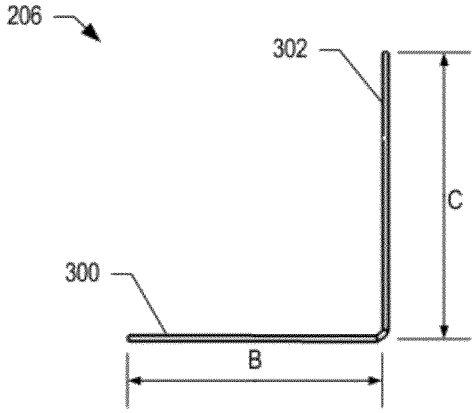

FIGS. 3A-3C illustrate an example HDMI retaining tab 206. FIG. 3A illustrates a perspective view of the example HDMI retaining tab 206. FIG. 3B illustrates a front view of the example HDMI retaining tab 206. FIG. 3C illustrates a side view of the example HDMI retaining tab 206.

The example HDMI retaining tab 206 includes a horizontal plate 300 and a vertical plate 302. The horizontal plate 300 has a width dimension 'A' and a length dimension 'B'. In some implementations, 'A' can be approximately 13 millimeters. In some implementations, 'A' is equal to or less than the width of a male HDMI connector (approximately 14 millimeters) but greater than the diameter of the retaining hole 208 (e.g., 3 millimeters). Dimension 'B' is generally great enough to provide adequate strength to the retaining tab 206 and sufficient material for attaching the retaining tab 206 to an HDMI cable. In some implementations, 'B' can be approximately 9 millimeters. The vertical plate 300 has a height dimension 'C' and a height to the center of the retaining hole 'D'. In some implementations, 'C' can be approximately 9 millimeters. In some implementations, 'D' can be approximately 6 millimeters. In some implementations, the vertical plate 302 shares the width dimension 'A' with the horizontal plate 300.

In some implementations, the retaining tab 206 is formed of one piece of material (metal, for example) bent at a substantially ninety degree angle to form horizontal and vertical plates. In some of these implementation, the material can be scored to permit easier and/or more accurate bending at the desired location.

The example HDMI retaining tab 206 can be placed under a sheath of an HDMI connector at the end of an HDMI cable at the time of manufacture. In implementations where the HDMI retaining tab is made of metal, an electrical connection can be made between the metal retaining tab 206 and the outer surface and/or ground wire of a male HDMI connector to facilitate grounding between two devices connected by the HDMI cable.

Figure 4:
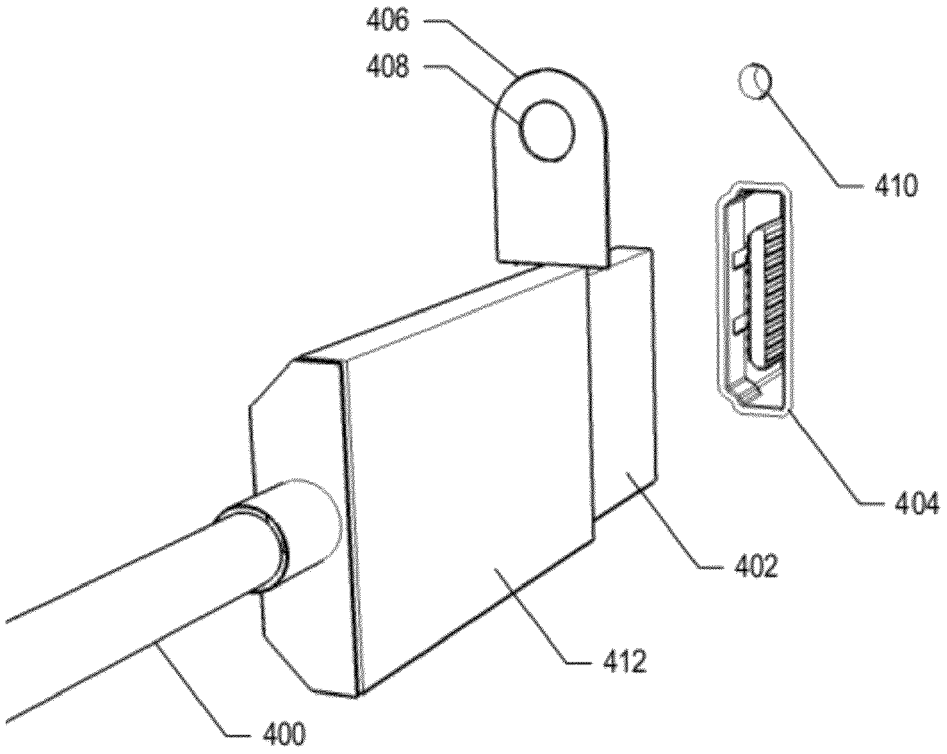
FIG. 4 illustrates a second example HDMI cable with a retaining mechanism.

FIG. 4 illustrates a second example HDMI cable 400 with a retaining mechanism. The example HDMI cable 400 includes a male HDMI connector 402, and it is shown prior to insertion in a female HDMI connector 404. The HDMI cable 400 includes a retaining tab 406 with retaining hole 408. A receiving hole 410 is located above the female HDMI connector 410. The HDMI cable 400 can also include connector sheath 412 between the male HDMI connector 402 and the insulated wire section of the cable for strain relief and protection of individual wire to pin connections at the male connector 402. The sheath 412 can also provide a gripping area to permit a human hand to grip the cable connector for inserting and removing the HDMI cable 400 from HDMI enabled devices.

As can be seen in FIG. 4, the retaining tab 406 of the HDMI cable 400 is oriented ninety degrees with respect to the male HDMI connector 402 as compared to the orientation of the retaining tab 206 with the male HDMI connector 202 depicted in FIG. 2A. This orientation can be desirable in certain applications where, for example, use of the orientation shown in FIG. 2A would be impeded by the design and/or connector area layout of the device to which the cable 400 is to be connected.

Figure 5A:
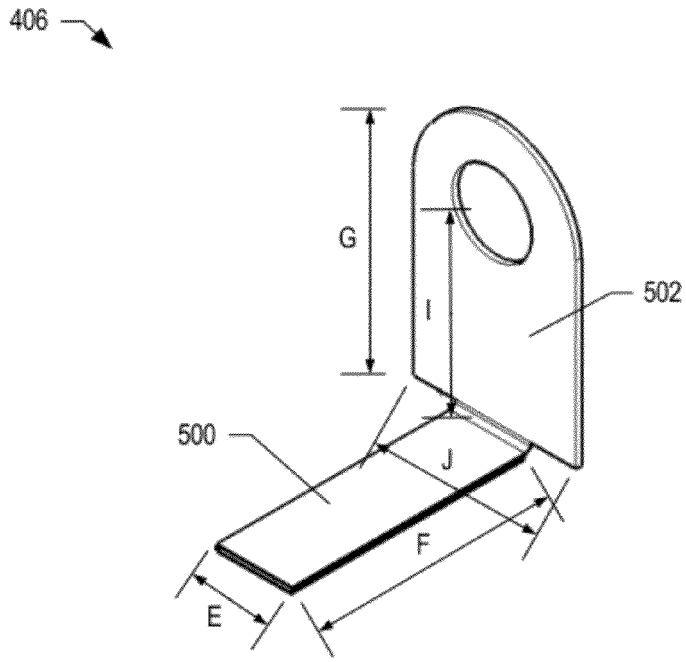
FIGS. 5A-5C illustrate a second example retaining tab.
Figure 5B:
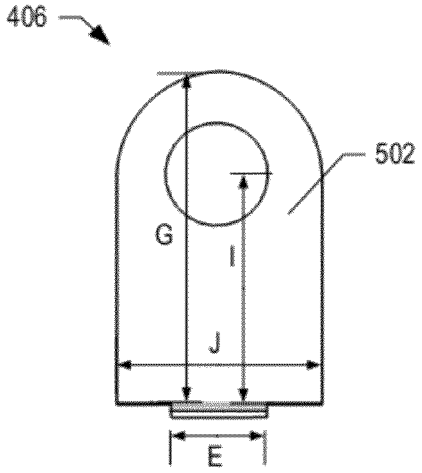
Figure 5C:
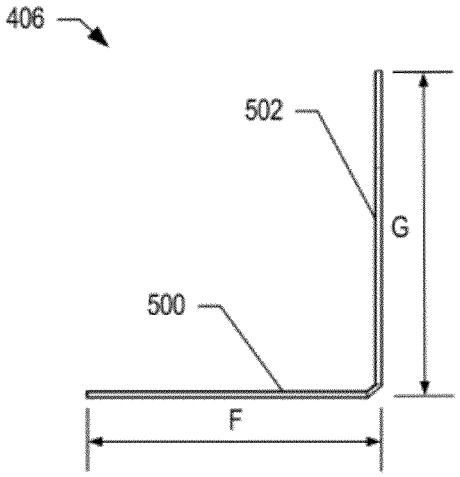

FIGS. 5A-5C illustrate a second example retaining tab 406. FIG. 5A illustrates a perspective view of the example retaining tab 406. FIG. 5B illustrates a front view of the example retaining tab 406. FIG. 5C illustrates a side view of the example retaining tab 406.

The example HDMI retaining tab 406 includes a horizontal plate 500 and a vertical plate 502. The horizontal plate 500 has a width dimension 'E' and a length dimension 'F'. In some implementations, 'E' can be approximately 3 millimeters. In some implementations, 'F' can be approximately 9 millimeters. The vertical plate 500 has a height dimension 'G', a width dimension 'J', and a height to the center of the retaining hole dimension 'I'. In some implementations, 'G' can be approximately 9 millimeters. In some implementations, 'I' can be approximately 6 millimeters. In some implementations, 'J' can be 5 millimeters.

In some implementations, the retaining tab 406 is formed of one piece of material (metal, for example) bent at a substantially ninety degree angle to form horizontal and vertical plates. In some of these implementation, the material can be scored to permit easier and/or more accurate bending at the desired location.

The example HDMI retaining tab 406 can be placed under a sheath of an HDMI connector at the end of an HDMI cable at the time of manufacture. In implementations where the HDMI retaining tab is made of metal, an electrical connection can be made between the metal retaining tab 206 and the outer surface and/or ground wire of a male HDMI connector to facilitate grounding between two devices connected by the HDMI cable.

Figure 6A:
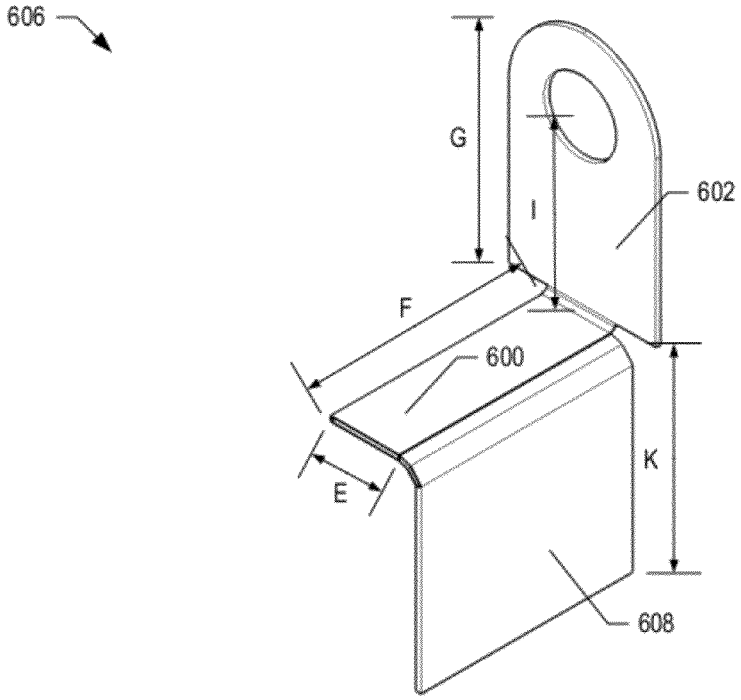
FIGS. 6A-6C illustrate a third example retaining tab.
Figure 6B:
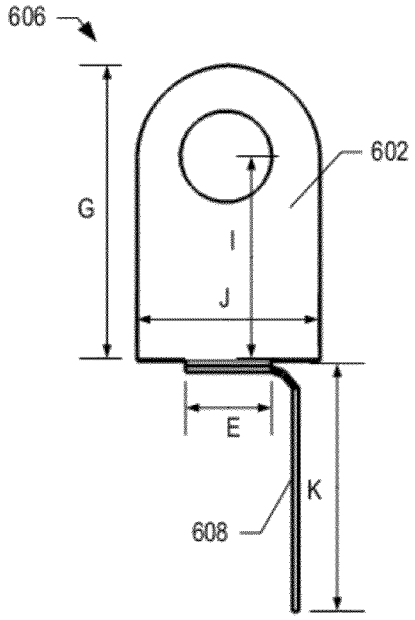
Figure 6C:
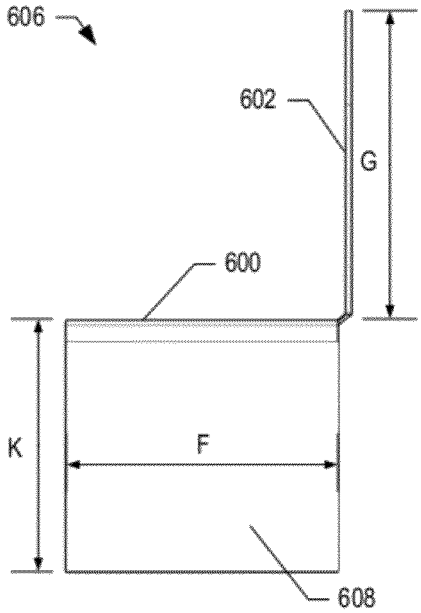

FIGS. 6A-6C illustrate an example retaining tab 606. FIG. 6A illustrates a perspective view of the example retaining tab 606. FIG. 6B illustrates a front view of the example retaining tab 606. FIG. 6C illustrates a side view of the example retaining tab 606.

The example retaining tab 606 is configured to be oriented similar to that of the retaining tab 406 described in FIGS. 5A-5C, but also includes an additional reinforcing plate 608. The reinforcing plate 608 extends down from the horizontal plate 600. The reinforcing plate 608 can, for example, follow the external contour of a male HDMI connector providing extra strength to the retaining tab 606 as compared, for example, to that of the retaining tab 406. The reinforcing plate 608 can have a height dimension 'K' and share dimension 'F' with the horizontal plate 600. In some implementations, 'K' can be 12 millimeters.

In some implementations, the retaining tab 606 is formed of one piece of material (metal, for example) bent at a substantially ninety degree angle to form horizontal and vertical plates and bent once again to form the reinforcing plate 608. In some of these implementations, the material can be scored to permit easier and/or more accurate bending at the desired location.

The example HDMI retaining tab 606 can be placed under a sheath of an HDMI connector at the end of an HDMI cable at the time of manufacture. In implementations where the HDMI retaining tab is made of metal, an electrical connection can be made between the metal retaining tab 606 and the outer surface and/or ground wire of a male HDMI connector to facilitate grounding between two devices connected by the HDMI cable.

In some implementations, an HDMI retaining mechanism can be integrated in an HDMI cable at the time of manufacture. In other implementations, an HDMI retaining mechanism can be used with HDMI cables that did not originally include a retaining mechanism.

Figure 7:
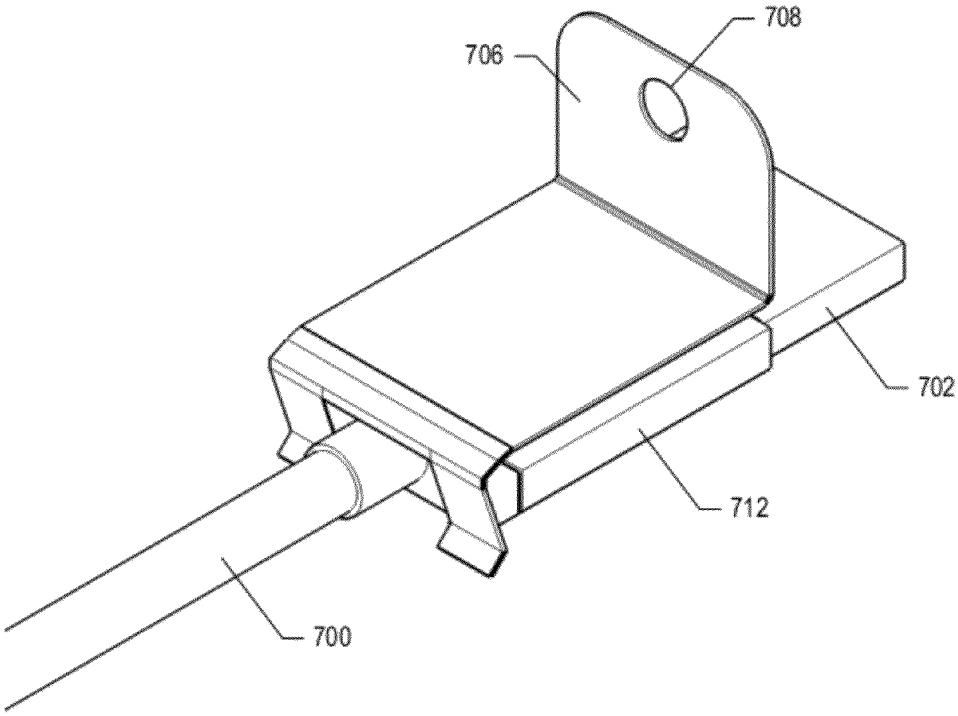
FIG. 7 illustrates an example environment of an example external retaining tab.

FIG. 7 illustrates an example environment of an external HDMI retaining tab 706. The external HDMI retaining tab 706 can be used, for example, to secure an HDMI cable that was not originally manufactured with a retaining mechanism. The external retaining tab 706 includes a retaining hole 708 and can be placed on an HDMI cable 700 having a male HDMI connector 702 and a sheath 712.

Figure 8A:
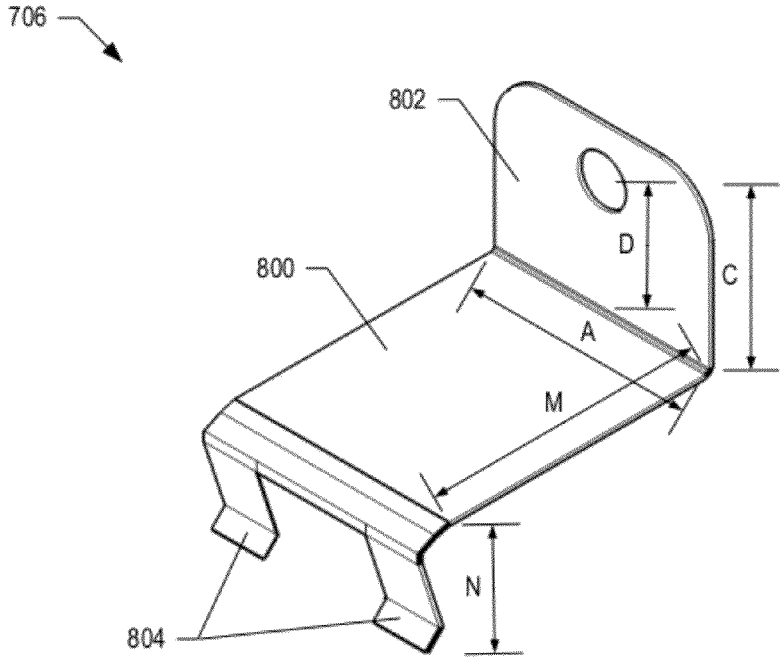
FIGS. 8A-8C illustrate an example external retaining tab.
Figure 8B:
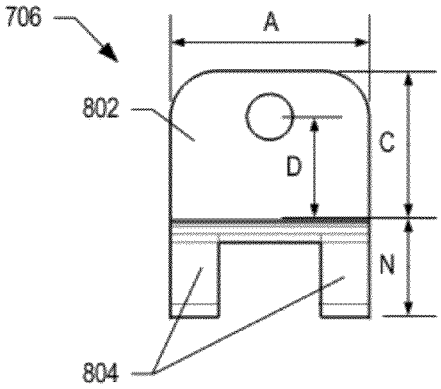
Figure 8C:
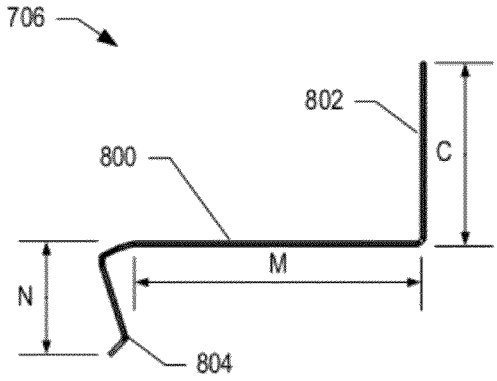

FIGS. 8A-8C illustrate an example external retaining tab 706. FIG. 8A illustrates a perspective view of the example retaining tab 706. FIG. 8B illustrates a front view of the example retaining tab 706. FIG. 8C illustrates a side view of the example retaining tab 706.

The example HDMI retaining tab 706 includes a horizontal plate 800 and a vertical plate 802. The horizontal plate 800 has a width dimension 'A' and a length dimension 'M'. In some implementations, 'A' can be approximately 9 millimeters. In some implementations, 'M' can be approximately 30 millimeters. The vertical plate 800 has a height dimension 'C' and a height to the center of the retaining hole 'D'. In some implementations, 'C' can be approximately 9 millimeters. In some implementations, 'D' can be approximately 6 millimeters.

The example HDMI retaining tab 706 also includes retaining prongs 804. When the retaining tab 706 is in use, the retaining prongs 804 can lie on either side of the insulated cable portion of an HDMI cable and press against a sheath of the HDMI cable to hold a male HDMI connector in place mated to a female HDMI connector of a device. The retaining prongs 804 have a height dimension 'N'. In some implementations, 'N' can be approximately 10 millimeters.

The dimensions 'M' and 'N' can vary depending on the size of the sheath of an HDMI cable with which the retaining tab 706 will be used. In some implementations, (e.g., where a given tab 706 has a dimension 'M' that is too long for a given HDMI cable) spacers between the prongs 804 and the HDMI cable can be used to ensure that the retaining tab 706 securely holds the HDMI cable in place. In some implementations, (e.g., where a given tab has a dimension 'M' that is too short for a given HDMI cable) a longer retaining screw and/or threaded standoffs between the screw and a device can be used.

In some implementations, the retaining tab 706 is formed of one piece of material (metal, for example) bent at a substantially ninety degree angle to form horizontal and vertical plates. The material can be bent again to form the retaining prongs 804. In some of these implementations, the material can be scored to permit easier and/or more accurate bending at the desired locations.

Figure 8D:
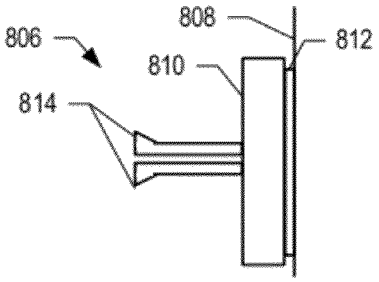

FIG. 8D illustrates a retaining clip 806. Where a given device does not include a receiving hole, a small clip can be used in place of the retaining screw/receiving hole combination. The retaining clip 806 is shown attached to the surface of a device 808. A base of the retaining clip 810 is attached to the surface of the device 808 using a layer of adhesive 812. The retaining clip 806 includes semi-flexible clip members 814 that can, for example, be displaced (e.g., pinched together) such that they will pass through the retaining hole of a retaining tab but then assume their former shape to capture the retaining tab, holding the HDMI retaining mechanism in place.

In some embodiments, the vertical plate can be held directly to the device using adhesive. In some of these embodiments the vertical plate does not include a retaining hole. In some embodiments, an external retaining tab made of elastically flexible material can be attached (e.g., glued) to a device. The retaining prongs of the external tab can be lifted (e.g. bent) upwards to permit an HDMI cable to inserted and removed. While the HDMI cable is attached to the device, the retaining prongs return to their undeformed position to hold the HDMI cable in place.

Figure 9A:
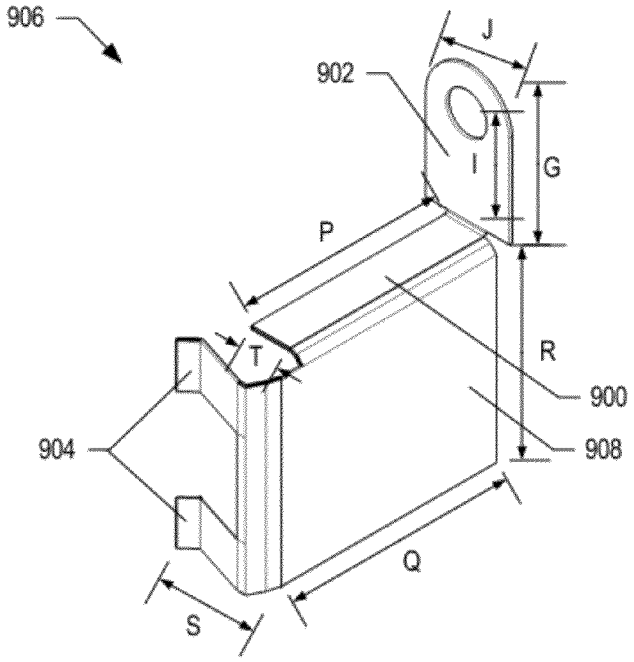
FIGS. 9A-9C illustrate a second example external retaining tab.
Figure 9B:
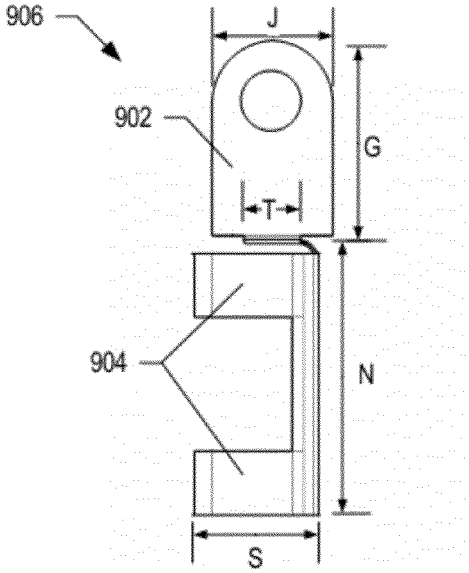
Figure 9C:
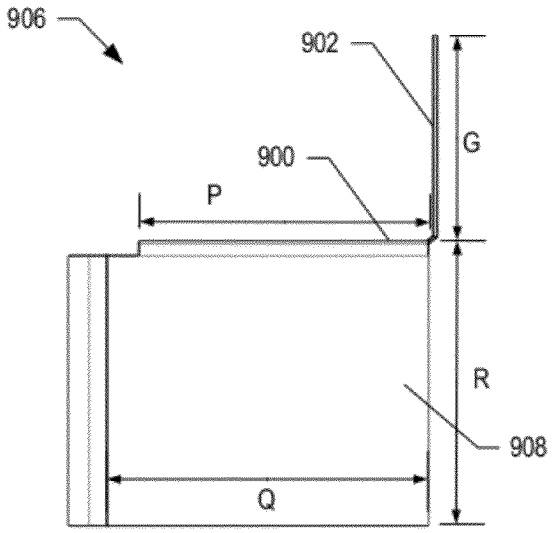

FIGS. 9A-9C illustrate an example external HDMI retaining tab 906. FIG. 9A illustrates a perspective view of the example HDMI retaining tab 906. FIG. 9B illustrates a front view of the example HDMI retaining tab 906. FIG. 9C illustrates a side view of the example HDMI retaining tab 906.

The example HDMI retaining tab 906 includes a horizontal plate 900, a vertical plate 902, side plate 908 and retaining prongs 904. The horizontal plate 900 has a width dimension 'T' and a length dimension 'P'. In some implementations, 'T' can be approximately 3 millimeters. In some implementations, 'P' can be approximately 24 millimeters. The vertical plate 900 has a height dimension 'G' and a height to the center of the retaining hole 'I'. In some implementations, 'G' can be approximately 9 millimeters. In some implementations, 'I' can be approximately 6 millimeters. The side plate has a length dimension 'Q' and a height dimension 'R'. In some implementations, 'Q' can be approximately 30 millimeters. In some implementations, 'R' can be approximately 13 millimeters.

The example HDMI retaining tab 906 also includes retaining prongs 904. When the retaining tab 906 is in use, the retaining prongs 904 can lie on either side of the insulated cable portion of an HDMI cable and press against a sheath of the HDMI cable to hold a male HDMI connector in place mated to a female HDMI connector of a device. The retaining prongs 804 have a dimension 'S'. In some implementations, 'S' can be approximately 10 millimeters.

The dimensions 'Q' and 'S' can vary depending on the size of the sheath of an HDMI cable with which the retaining tab 906 will be used. In some implementations, (e.g., where a given tab 906 has a dimension 'Q' that is too long for a given HDMI cable) spacers between the prongs 904 and the HDMI cable can be used to ensure that the retaining tab 906 securely holds the HDMI cable in place. In some implementations, (e.g., where a given tab has a dimension 'Q' that is too short for a given HDMI cable) a longer retaining screw and/or threaded standoffs between the screw and a device can be used.

Where a given device does not include a receiving hole, a small clip can be used in place of the retaining screw/receiving hole combination such as the retaining clip 806 of FIG. 8D.

In some implementations, the retaining tab 906 is formed of one piece of material (metal, for example) bent at a substantially ninety degree angle to form horizontal and vertical plates. The material can be bent again to form the side plate, and bent yet agains to form the retaining prongs 904. In some of these implementation, the material can be scored to permit easier and/or more accurate bending at the desired locations.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results.

Particular embodiments of the subject matter described in this specification have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results.

What is claimed is:

1. An apparatus comprising:

a male high definition multimedia interface (HDMI) connector;

a retaining tab comprising:

a vertical plate having a retaining hole; and a horizontal plate connected to the vertical plate, the retaining tab being configured to receive a fastener for maintaining the male HDMI connector in a position in which the male HDMI connector is mated to a female HDMI connector of a device, wherein the retaining tab comprises metal and is electrically connected to a ground pin of the male HDMI connector.

2. The apparatus of claim 1 further comprising a sheath covering at least part of the retaining tab.

3. The apparatus of claim 1 further comprising:

a plurality of conductors electrically connected to respective pins of the male HDMI connector; and a sheath covering at least part of the retaining tab and covering an interface area where the plurality of conductors are attached to the respective pins of the male HDMI connector.

4. The apparatus of claim 1, wherein the vertical plate and the horizontal plate are formed of a piece of material bent at a substantially ninety degree angle between the horizontal plate and the vertical plate.

5. The apparatus of claim 1, wherein the retaining hole is configured to receive a fastener for holding the retaining tab in a position against a chassis of the device.

6. The apparatus of claim 1, further comprising a shielding case.

7. The apparatus of claim 1, wherein the vertical plate, the horizontal plate, and at least a portion of the shielding case are formed of a piece of metal bent to form the vertical plate, horizontal plate, and the at least a portion of the shielding case.

8. The apparatus of claim 1, wherein the male HDMI connector includes a first side, a second side, a third side, and a fourth side, the first and third sides being equal in length and parallel to each other, the second and fourth sides being equal in length and parallel to each other, the first and third sides being shorter in length than the second and fourth sides, and wherein the retaining hole is located in a posotion on the vertical plate where a line from the center of the retaining hole through the vertical plate to the male HDMI connector is normal to the second and fourth sides.

9. The apparatus of claim 1, wherein the male HDMI connector includes a first side, a second side, a third side, and a fourth side, the first and third sides being equal in length and parallel to each other, the second and fourth sides being equal in length and parallel to each other, the first and third sides being shorter than the second and fourth sides, and wherein the retaining hole is located in a position in the vertical plate where a line drawn from the center of the retaining hole through the vertical plate to the male HDMI connector is normal to the first and third sides.

10. An apparatus comprising:

a male high definition multimedia interface (HDMI) connector;

a retaining tab comprising:

a vertical plate having a retaining hole; and a horizontal plate connected to the vertical plate, the retaining tab being configured to receive a fastener for maintaining the male HDMI connector in a position in which the male HDMI connector is mated to a female HDMI connector of a device;

a plurality of insulated conductors electrically connected to respective pins of the male HDMI connector; and a shield wire shielding the plurality of conductors from external radio frequency interference and wherein the retaining tab comprises metal and is electrically connected to the shield wire.

11. An apparatus comprising:

a male high definition multimedia interface (HDMI) connector;

a retaining tab comprising:

a vertical plate having a retaining hole; and a horizontal plate connected to the vertical plate, the retaining tab being configured to receive a fastener for maintaining the male HDMI connector in a position in which the male HDMI connector is mated to a female HDMI connector of a device, wherein the retaining hole is configured to receive a screw having a threaded shaft passing through the retaining hole and being threaded into a receiving hole of the device, and the retaining tab is metal and the screw creates an electrical connection between the retaining tab and a chassis of the device.

12. An apparatus comprising:

a male high definition multimedia interface (HDMI) connector;

means for retaining the male HDMI connector to a device having a female HDMI connector, wherein the means for retaining is electrically connected to a ground pin of the male HDMI connector;

a plurality of conductors electrically connected to respective pins of the male HDMI connector; and a sheath covering at least part of the means for retaining and covering an interface area where the plurality of conductors are attached to the respective pins of the male HDMI connector.

13. An apparatus comprising:

a high definition multimedia interface (HDMI) connector retaining tab comprising:

a vertical plate;

a horizontal plate connected to the vertical plate; and first and second retaining prongs being spaced apart so as to lie on respective sides of an HDMI cable to which the HDMI connector retaining tab is proximate and configured to press against a sheath of the HDMI cable to hold a male HDMI connector of the cable in a position in which the male HDMI connector is mated to a female HDMI connector of a device, wherein the vertical plate, the horizontal plate, and the retaining prongs are formed of a single piece of material bent at a substantially ninety degree angle between the horizontal plate and the vertical plate, and wherein the vertical plate includes a retaining hole for receiving a fastener for holding the retaining tab proximate to a device having a female HDMI connector.

14. The apparatus of claim 13, wherein the single piece of material is bent at a substantially ninety degree angle between the horizontal plate and the retaining prongs.

* * * * *